United States Patent [19]

Molins et al.

[11] 4,069,829

[45] Jan. 24, 1978

[54] MANUFACTURE OF CIGARETTES AND THE LIKE

[75] Inventors: Desmond Walter Molins, London, England; Francis Auguste Maurice Labbe, Neuilly sur Seine, France

[73] Assignee: Molins Limited, London, England

[21] Appl. No.: 291,495

[22] Filed: Sept. 22, 1972

[30] Foreign Application Priority Data

Sept. 24, 1971 United Kingdom ..... 44755/71

[51] Int. Cl.[2] ..... A24C 5/18

[52] U.S. Cl. ..... 131/84 C; 131/21 D

[58] Field of Search ..... 131/8, 21, 21 B, 21 D, 131/84, 84 B, 84 C, 108, 109 R, 64.66

[56] References Cited

U.S. PATENT DOCUMENTS

| | | | |
|---|---|---|---|
| 1,183,618 | 5/1916 | Aiton | 131/109 R |
| 1,829,559 | 10/1931 | Gilliam | 131/8 R |
| 2,815,759 | 12/1957 | Molins et al. | 131/21 B |
| 2,861,683 | 11/1958 | Gilman | 131/21 B X |
| 3,089,497 | 5/1963 | Molins et al. | 131/21 D |
| 3,113,576 | 12/1963 | Bell | 131/21 D |
| 3,173,424 | 3/1965 | Gamberini | 131/84 C |
| 3,298,376 | 1/1967 | Kochalski | 131/84 C |
| 3,525,344 | 8/1970 | Neuber | 131/84 C X |
| 3,548,837 | 12/1970 | Cristiani | 131/84 B |
| 3,549,293 | 12/1970 | Wilde et al. | 131/21 D |
| 3,589,373 | 6/1971 | Hooper | 131/84 B X |

FOREIGN PATENT DOCUMENTS

| | | | |
|---|---|---|---|
| 331,333 | 7/1930 | United Kingdom | 131/21 D |
| 995,604 | 6/1965 | United Kingdom | 131/21 D |
| 1,093,966 | 12/1967 | United Kingdom | 131/84 C |
| 1,231,384 | 5/1971 | United Kingdom | 131/84 C |
| 986,640 | 3/1965 | United Kingdom | 131/84 C |
| 919,150 | 2/1963 | United Kingdom | 131/84 C |

*Primary Examiner*—Stephen C. Pellegrino
*Assistant Examiner*—V. Millin
*Attorney, Agent, or Firm*—John C. Smith, Jr.

[57] ABSTRACT

A continuous carpet of particulate cigarette filler material, of which part along one side comprises core such as a low quality tobacco or non-tobacco material and the remainder comprises normal tobacco, is rolled by means of an air jet, starting from the core material side of the carpet, to form a cigarette filler stream consisting of an annulus of normal tobacco around a core consisting of the core material. Before the annulus tobacco is rolled around it, the rolled core material is trimmed to remove excess core material. Furthermore, a variable part of the normal tobacco in the carpet is discarded under the control of a sensor responding to the density of the nearly completely formed filler stream.

16 Claims, 7 Drawing Figures

MANUFACTURE OF CIGARETTES AND THE LIKE

Our U.S. patent application Ser. No. 22955, filed Mar. 26, 1970; now U.S. Pat. No. 3,736,941, describes various possible machines for making a cigarette including a core, for example of low-quality tobacco or non-tobacco material, surrounded by an annulus of good tobacco. FIGS. 12 to 18 of the above specification show examples of machines which form the cigarette filler by first forming a carpet of which part along one side is of particulate core material (e.g. shredded artificial tobacco), and then rolling the carpet progressively by means of an air jet from the side formed by the core material, so that the core material is rolled by the air jet into the middle of an annulus formed by the good tobacco. The present invention is concerned with improvements in such machines.

In this context it should be noted that the term "cigarette" is intended to cover both cigarettes and similar smokable rod-like articles.

According to one aspect of the present invention, a trimmer is included to trim the rolled core stream before the tobacco is rolled around it. The purpose of this is to keep the weight per unit length or density of the core stream substantially constant. Preferred features of this aspect of the invention are disclosed further on in the description and claims.

According to another aspect of this invention, in a cigarette making machine in which the cigarette filler stream is formed by rolling a carpet of tobacco by means of an air jet around a core (e.g. a preformed rod or rope) there are means for sensing the weight per unit length or density of the nearly completed filler stream and for controlling the amount of further tobacco which is subsequently added to complete the filler stream, so as to maintain the mass per unit length or density of the finally completed stream substantially constant.

An example of a machine according to this invention is show in the accompanying drawings. In these drawings.

Figure 1:
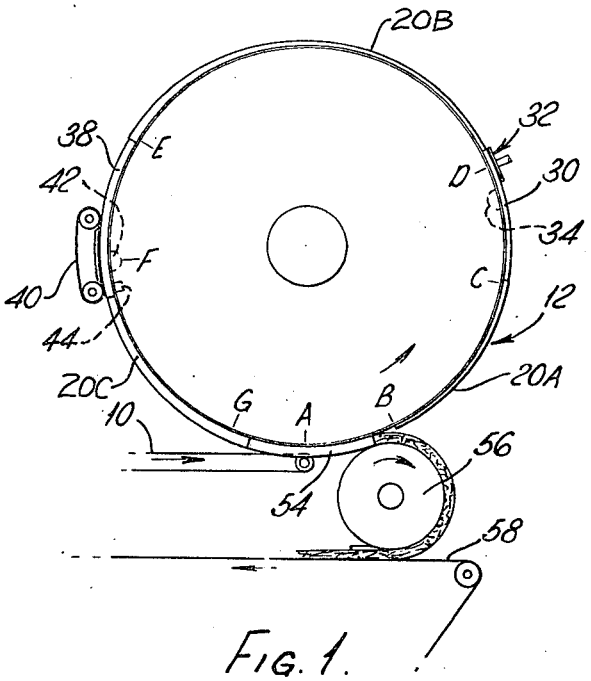
FIG. 1 is a side view showing a drum on which the carpet is rolled while being conveyed by the drum.
Figures 2, 7:
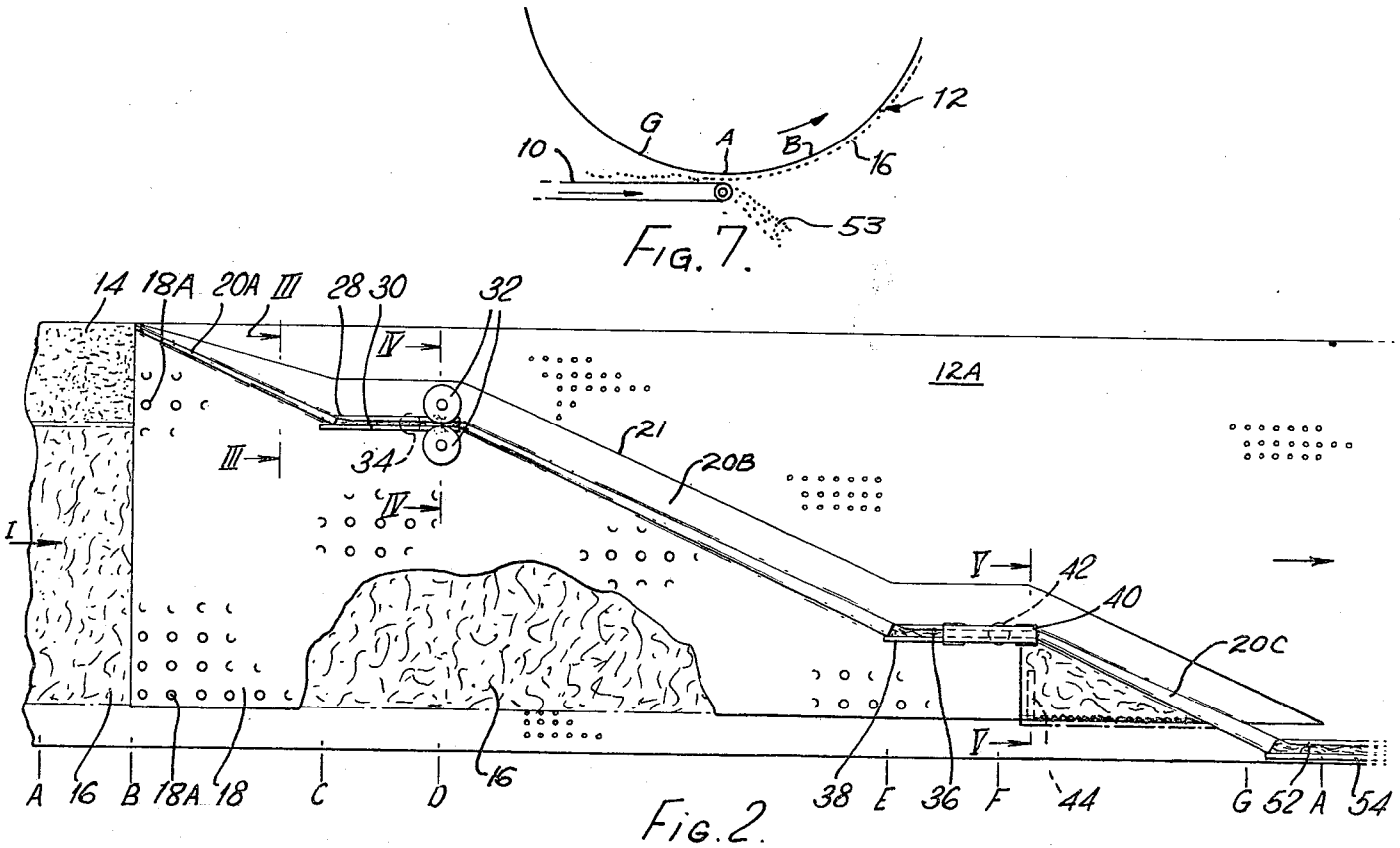
FIG. 2 is a flat developed view of the surface of the drum and the cover, a portion thereof being broken away.
FIG. 7 is a partial side view similar to FIG. 1 showing a further detail.

As shown in FIG. 1, a conveyor band 10 projects a carpet of cigarette filling material horizontally just below a rotatable drum 12. The carpet consists of a strip 14 of particulate core mateial (see FIG. 2) and a wider part 16 of good or normal tobacco. The peripheral surface 12A of the drum is rough and air-pervious so that suction within the drum creates a radially inward air stream from stage A to stage B to suck the carpet on to the drum. However, as illustrated in FIG. 7, the arrangement may be such that any heavy pieces 53 such as stem included with the normal tobacco 16 (or with the core material) fly on under their own inertia and are not sucked on to the drum 12; that is to say, a winnowing operation may occur at this stage.

An air-pervious cover 18 containing a plurality of apertures 18A is spaced from the peripheral surface 12A of the drum and extends about the drum from stage B through to a point coincident with the beginning of Stage A. The air-pervious cover is of generally progressively decreasing width as viewed in the direction of movement of the carpet (see FIG. 2). The air-pervious cover extends to the right-hand edge of the carpet and terminates at the left with inverted troughs 20A, 20B and 20C connected by walls 28, 30 and 36, 38 and a flange 21.

Figure 3:
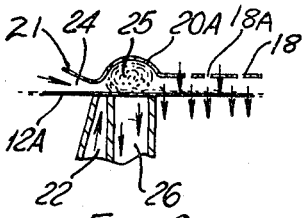
FIGS. 3 to 5 are enlarged sections on the lines III—III, IV—IV, and V—V in FIG. 2.

From stage B to stage C the part of the carpet formed from core material is progressively rolled by means of air in the manner described basically in the above application. For this purpose the drum is covered in this region across a progressively decreasing width by a stationary air-pervious cover 18 mounted in a known manner (see U.S. Pat. No. 3,548,837). Within the trough 20A the core material is rolled by the action of an air jet delivered through a passage 22 (FIG. 3), together with air which flows in from the atmosphere through a throat 24 defined by drum surface 12A and flange 21, thus forming a core stream 25. To the right of the trough 20A, slight suction is applied through the drum from a suction space within the drum to hold the carpet on the drum, while a slightly higher suction pressure is applied through the drum from a passage 26. The trough 20A may also be air-pervious.

Figure 4:
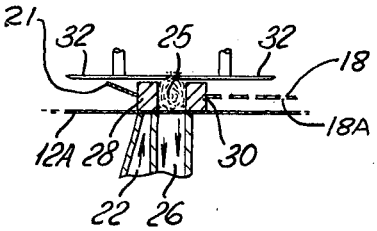

By stage C the whole section of the carpet formed by core material has been rolled to form the core stream 25. This stream is then passed between fixed side walls 28 and 30 (see FIG. 4) which confine the sides of the stream while the stream is packed by suction applied through the passage 26. At stage D, as shown in FIG. 4, the core stream is trimmed, for example by means of a trimmer comprising cooperating discs 32 with a brush or other means (not shown) for removing the discard material which is separated from the main body of the stream by the discs. The distance of the discs from the surface of the drum varies in response to the density of the core stream which is sensed by means of an air cell 34 (see FIG. 1) which may for example have a pipe connection to a suction source and a separate pipe connection to a pressure-sensitive device, so that the suction pressure felt by the pressure-sensitive device is dependent upon the density of the core stream; this is basically in accordance with U.S. Pat. No. 3,089,497.

From stage D the rolling continues in trough 20B so that the normal tobacco 16 is progressively rolled round the core stream 25 to form a filler stream 25' with a core surrounded by an annulus of normal tobacco. For this purpose the trough 20B becomes progressively larger in cross section to accommodate the increasing diameter of the filler stream 25. It should be appreciated that no suction is applied through the drum to the left of the trough 20B as viewed in the direction of arrow I in FIG. 2.

By stage E, approximately 70% of the total normal tobacco has been rolled round the core material. From this stage until stage F the stream is passed between parallel fixed walls 36 and 38 which confine the sides of the stream while suction applied through the passage 26 packs the stream. Furthermore an air-pervious band 40 is in close contact with the fixed walls 36 and 38 and pushes the stream into the space between the fixed walls so as to maintain the cross section of the stream substantially constant. While the stream is thus confined between the drum, the band and the fixed walls, its density is sensed by a second air cell 42. The signal derived from the air cell is used to throw off part of the remaining normal tobacco 16, as shown in FIGS. 5 and 6, to maintain the final cigarette filler stream at a substantially constant density.

Figure 5:
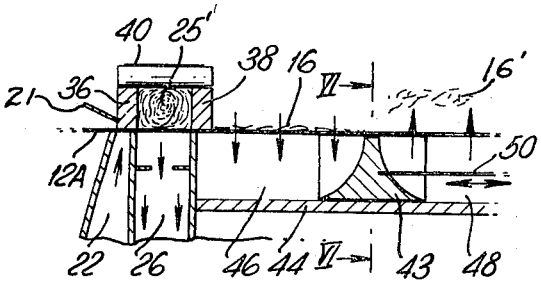
Figure 6:
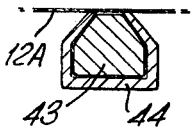
FIG. 6 is a section on the line VI—VI in FIG. 5.

As shown in FIGS. 5 and 6, a light-weight shutter 43 is arranged to move along a channel 44 which is parallel to the axis of the drum. A space 46 to the left of the shutter (FIG. 5) is connected by any conventional means to a source of suction so that a corresponding part of the normal tobacco left on the drum is retained on the drum. To the right of the shutter 43 a space 48 is connected by any conventional means to a source of compressed air so that the tobacco to the right of the shutter is blown off the drum. The position of the shutter is controlled by a wire 50 which is held in tension by the pressure differential on opposite sides of the shutter, the positive pressure to the right of shutter 43 and the suction to the left of the shutter 43 urging the shutter to the left. From stage F to stage G the rolling of the cigarette filler stream is completed in trough 20C and the finished stream is conveyed between fixed walls 52 and 54 to a suction wheel 56 which carries the stream on to a continuous wrapper web 58 in which the stream is enclosed to form a continuous cigarette rod.

Either or both of the air cells 34 and 42 may be replaced by some other form of density sensing device, for example a Beta ray device. (See U.S. Pat. No. 2,809,638).

Instead of the core material being fed on to the drum 12 in the form of the carpet section 14 of particulate material, it could be fed on as a coherent but flexible rod or rope, or as a succession of spaced rod or rope sections as described in U.S. Pat. No. 3,736,941. In this case it is unnecessary to use the trimmer 32, and the filler forming operation in effect starts at stage D, at which position the rod or rope is fed on to the drum.

We claim:

1. A cigarette making machine comprising means for forming a wide, continuous carpet of particulate cigarette filler material of predetermined width, an air-pervious conveyor for supporting the carpet on one surface thereof and continuously conveying the carpet along a path, means for progressively gathering in at least one edge of the carpet as it is conveyed to form said filler material into a narrow stream, sensing means for sensing the mass of said narrow stream, and ejector means responsive to said sensing means for ejecting a variable part of the filler material forming the carpet to maintain the mass of said narrow stream substantially constant, said ejector means comprising a shutter mounted adjacent the opposite surface of said conveyor and adjustable in position along a further path transversely of said path of the conveyor and means for supplying air at above-atmospheric pressure to said opposite surface of said air-pervious conveyor adjacent one side of the shutter whereby the portion of the carpet lying on said one side of the shutter is blown off the conveyor.

2. A cigarette making machine comprising means for forming a continuous carpet of particulate cigarette filler material of predetermined width, air-pervious conveyor means for supporting and conveying said carpet on one surface thereof along a path, means for progressively forming the filler material of said carpet while conveyed along said path into a narrow stream of filler material, sensing means for sensing the mass of said narrow stream, a shutter mounted adjacent the opposite surface of said conveyor, means for moving the shutter along a further path transversely of said path of the conveyor in response to the sensing means, and pneumatic means for removing from said carpet a strip of filler material, said shutter being arranged to control the width of said strip removed from said carpet to maintain the mass of said narrow stream of filler material substantially constant.

3. A cigarette making machine for forming a cigarette filler stream from an elongated carpet of particulate material, part along one side thereof consisting of particulate core material and the remainder consisting of particulate normal tobacco, said core material having a different composition than said particulate normal tobacco, said machine comprising:

a. an elongated air-pervious conveyor having a surface for supporting and conveying said carpet along a path to a position at which formation of said filler stream is completed, b. stationarily mounted trough means arranged obliquely across said surface of said elongated air-pervious conveyor and having an open side thereof spaced from and confronting said surface;

c. air jet means arranged to project air through said air-pervious conveyor into said trough means for progressively rolling said carpet in said trough means while said carpet is being conveyed along said path and commencing at the side supporting said core material to form a filler stream comprising rolled particulate core material surrounded by an annulus of rolled particulate normal tobacco, d. stationarily mounted means for trimming excess particulate core material from the rolled core material at a trimming station along said path at said one side supporting said rolled core material and before the annulus of particulate normal tobacco is rolled about said rolled core material, and e. pneumatic means for retaining the unrolled portion of said carpet on said conveyor while said carpet is being rolled by said air jet means and said excess core material is trimmed.

4. A cigarette making machine according to claim 3 further comprising fixed side guides at said trimming station and having spaced confronting surfaces transverse to said surface of said conveyor for confirming said rolled core material while passing through said trimming station, said trough means comprising a first and a second trough, both arranged obliquely across said surface of said conveyor, said first trough extending from one edge of said conveyor surface in an oblique downstream direction to said side guides and said second trough extending in an oblique downstream direction from said side guides.

5. A cigarette making machine according to claim 4 including a sensing device for sensing the mass of the rolled core material before its arrival at said trimming station and for continuously controlling said trimming means to maintain the mass of the rolled core material substantially constant.

6. A cigarette making machine according to claim 3 including means, located along said path at a further position between said trimming station and said position at which formation of the filler stream is completed, for sensing the mass of the partially formed filler stream and for controlling the amount of particulate normal tobacco, in the portion of said carpet between said sensing means and said position at which formation of said filler stream is completed, which is subsequently rolled by said air jet means to complete formation of the filler stream, so as to maintain the mass of the completely formed filler stream substantially constant.

7. A cigarette making machine according to claim 6 wherein said second trough extends obliquely from said trimming station to said sensing means, said trough means further comprising a third trough arranged to extend in an oblique downstream direction from said sensing means to said position at which formation of said filler stream is completed.

8. A cigarette making machine according to claim 3 wherein said conveyor comprises a suction drum rotatable about a substantially horizontal axis and having a peripheral surface for supporting and conveying said carpet, a delivery conveyor for delivering said carpet to the peripheral surface of said drum at a position substantially below said axis and a further conveyor for receiving the completely formed filler stream from the peripheral surface of said drum at a position substantially below said axis.

9. A cigarette making machine according to claim 8 wherein said delivery conveyor is arranged relative to said suction drum such that average and light weight particles in the carpet when leaving the delivery conveyor are sucked onto the peripheral surface of the drum, while relatively heavy particles continue under their own inertia from the delivery conveyor and are not sucked onto the peripheral surface of the drum.

10. A cigarette making machine for forming a cigarette filler stream from an elongated carpet of particulate tobacco comprising:

a. an elongated air-pervious conveyor having a surface for supporting and conveying said carpet along a path,
b. stationarily mounted trough means arranged obliquely across said elongated air-impervious conveyor and having an open side thereof spaced from and confronting said surface,
c. air jet means arranged to project air through said air-pervious conveyor into said trough means for progressively rolling said carpet in said trough means while being conveyed along said path and commencing at one side thereof at a first position along said path to progressively form said filler stream and complete formation at a second position spaced from said first position,
d. means, located at a third position between said first and second positions where said filler stream has been partially formed, for sensing the mass of the partially formed filler stream at said third position,
e. means responsive to said sensing means for controlling the amount of particulate tobacco in said carpet which is subsequently rolled by said air jet means to complete formation of the filler stream, so as to maintain the mass of the completely formed filler stream substantially constant, and
f. pneumatic means for retaining the unrolled portion of said carpet on said conveyor.

11. A cigarette making machine according to claim 10 in which the sensing means comprises further pneumatic means for detecting the resistance to air flow through said partially formed filler stream, said machine further comprising means cooperating with said surface of said conveyor for confining said partially formed filler stream on all sides at said third position, as seen in cross-section, so that the cross-section of said filler stream is maintained at a predetermined value at said third position.

12. A cigarette making machine according to claim 10 wherein said means for controlling the amount of particulate tobacco in said carpet comprises means for blowing part of the tobacco carpet off said conveyor, and a shutter movable along a further path transverse to the path of said conveyor for controlling the width of the part of the carpet blown off, said width being measured transversely to the direction of movement of the carpet along said conveyor path.

13. A cigarette making machine comprising means for forming a carpet of particulate cigarette filler material of predetermined width, air-pervious conveyor means having a surface for supporting and conveying said carpet along a predetermined path between first and second stations, means for progressively narrowing the carpet, as it moves from said first station to said second station along the path, to form a narrow filler stream of said filler material, sensing means mounted at a third station along said path between said first and second stations for sensing the mass of the partly formed narrow stream, a shutter mounted adjacent the surface of said conveyor opposite said supporting surface, means for moving the shutter along a further path transverse to said path of the conveyor in response to the sensing means, and pneumatic means situated at a fourth station between said first and second stations for removing from said carpet a strip of filler material, said shutter being arranged to control the width of said strip removed from said carpet to maintain the mass of said narrow filler stream substantially constant.

14. A method for forming a cigarette filler stream from a carpet of particulate material comprising:

a. feeding a continuous carpet of said particulate material along a path between first and second positions, part of said carpet along one side thereof consisting of particulate core material and the remainder consisting of particulate normal tobacco, said core material having a different composition than said particulate normal tobacco,
b. directing an air jet towards said carpet to progressively roll said carpet commencing at said first position at the side consisting of core material to first form a rolled core material,
c. trimming excess core material from the rolled core material sufficient to maintain the mass of the rolled core material substantially constant, and
d. after said trimming step, directing said air jet to progressively roll an annulus of said normal tobacco about said rolled and trimmed core material while approaching said second position.

15. The method of claim 1 further comprising sensing the mass of said rolled core material before trimming and controlling said trimming of excess core material in accordance with the sensed mass to maintain the weight per unit length of the rolled core material substantially constant.

16. The method of claim 15 further comprising sensing the mass of the filler stream at a third position along said path intermediate said first and second positions where said filler stream is only partially formed and removing from said carpet a portion of said normal tobacco in accordance with the sensed mass to control the amount of further normal tobacco subsequently rolled about said core material to maintain the mass of the completely formed filler stream substantially constant.

* * * * *